US010123669B2

(12) United States Patent
Edwards

(10) Patent No.: US 10,123,669 B2
(45) Date of Patent: Nov. 13, 2018

(54) MULTI-PURPOSE TOILET FOOTREST

(71) Applicant: Judy M. Edwards, St. George, UT (US)

(72) Inventor: Judy M. Edwards, St. George, UT (US)

(73) Assignee: Squatty Potty, LLC, St. George, UT (US)

( * ) Notice: Subject to any disclaimer, the term of this patent is extended or adjusted under 35 U.S.C. 154(b) by 0 days.

(21) Appl. No.: 15/605,796

(22) Filed: May 25, 2017

(65) Prior Publication Data

US 2017/0340175 A1 Nov. 30, 2017

Related U.S. Application Data

(60) Provisional application No. 62/346,989, filed on Jun. 7, 2016, provisional application No. 62/341,521, filed on May 25, 2016.

(51) Int. Cl.
*E03D 11/00* (2006.01)
*A47K 17/02* (2006.01)

(52) U.S. Cl.
CPC ..... *A47K 17/028* (2013.01)

(58) Field of Classification Search
CPC ..... A47K 17/028
USPC ..... 4/254
See application file for complete search history.

(56) References Cited

U.S. PATENT DOCUMENTS 4,713,846 A * 12/1987 Hodroski, Jr. ..... A47K 17/00 4/254
8,317,268 B2 * 11/2012 Alkhattaf ..... A47C 16/02 297/423.39
2015/0272410 A1 * 10/2015 Lavassani ..... A47K 17/028 4/254

* cited by examiner

*Primary Examiner* — Huyen Le
(74) *Attorney, Agent, or Firm* — Gurr Brande & Spendlove, PLLC; Robert A. Gurr

(57) ABSTRACT

A multi-purpose toilet footrest has a first foot platform, a second foot platform, and a receptacle interposed between the first and second foot platforms. A user places their legs on the foot platforms when using the toilet to place their body in a squatting position and may store or dispose items in the receptacle.

5 Claims, 4 Drawing Sheets

MULTI-PURPOSE TOILET FOOTREST

CROSS-REFERENCE TO RELATED APPLICATIONS

This application claims the benefit of U.S. Provisional Application Ser. No. 62/341,521, filed on May 25, 2016, and U.S. Provisional Application Ser. No. 62/346,989, filed on Jun. 7, 2016, both of which are incorporated herein by reference.

TECHNICAL FIELD

The present disclosure relates to toilet footrests. More specifically, the present disclosure relates to a toilet footrest that serves multiple purposes, such as a waste bin, toilet paper holder, container, and more.

BACKGROUND

Humans can perform defecation in different postures; the two most common are squatting or sitting positions. The squatting posture is usually used when using a squat toilet (mainly a feature of the developing world), or when toilets are unavailable. The sitting posture during defecation is a standard posture seen in the western world because western-style toilets usually require a sitting position with the back erect and the knees away from the chest in about a ninety-degree angle.

The anorectal angle, which is the angle formed in the colon where the puborectalis muscle wraps around the rectum, is a very important factor in maintaining continence. The sitting posture common to western-style toilets causes a narrowing of the anorectal angle and prevents the puborectalis muscle from relaxing, which may cause difficulty in emptying the bowels.

Additionally, the sitting position may cause the person to repeat the Valsalva maneuver, i.e., exhalation against a closed airway to increase internal pressure, holding his breath to increase internal pressure, which can lead to syncope. A sitting posture may increase issues related to weakness in the colon wall because of the increased straining needed to defecate.

In contrast, the squatting defecation posture involves squatting by standing with the knees and hips sharply bent and the buttocks suspended near the ground. By using the squatting defecation posture, the anorectal angle is increased which allows the puborectalis muscle to fully relax which aids defecation by reducing the amount of effort needed to empty the bowels.

The advantages of the squatting position may be obtained when using western-style toilets (i.e., where the bowl is raised from the ground is intended for sitting as opposed to squatting) in conjunction with a footrest. Footrests help raise the knees toward the chest and help to lessen the normal sitting angle of about ninety-degrees to much less. As the feet are raised, the puborectalis muscle relaxes, the colon aligns allowing gravity to aid evacuation, and the required expulsive effort lessens. As such, several footrests exist in the art that are aimed at allowing a human to achieve a better anorectal angle while sitting on a toilet.

However, restroom space is an ongoing concern for many users. In other words, most restrooms are designed to fit a toilet, and little else. Many restrooms have a waste basket next to the toilet for personal care items and other things that should not be flushed. Some users also store personal care items, toilet paper, or other essentials in the restroom as well.

As such, there is little-to-no space left for a toilet footrest. Therefore, there remains a need to maximize the space in a restroom. The present invention seeks to solve these and other problems.

SUMMARY OF EXAMPLE EMBODIMENTS

In one embodiment, a multi-purpose footrest comprises a first foot platform coupled to a second foot platform via at least one brace member; and a receptacle interposed between the first and second foot platforms.

In one embodiment, a multi-purpose footrest comprises an aperture for receiving a removable receptacle, the toilet footrest being configured to accommodate the feet of a user.

In one embodiment, a multi-purpose footrest comprises a foot platform hingedly attached to a base portion, the base portion being comprised of a housing and an inner space or void for receiving items directly or a removable receptacle sized to fit within the void, the foot platform being configured to complement the base of a toilet.

In one embodiment, a multi-purpose footrest comprises one or more collapsible footrests coupled to the side of a receptacle.

In still yet other embodiments, additional accessories may be coupled therewith, such as toilet paper holders or other items typically found in the restroom.

DETAILED DESCRIPTION OF EXAMPLE EMBODIMENTS

Figure 1:
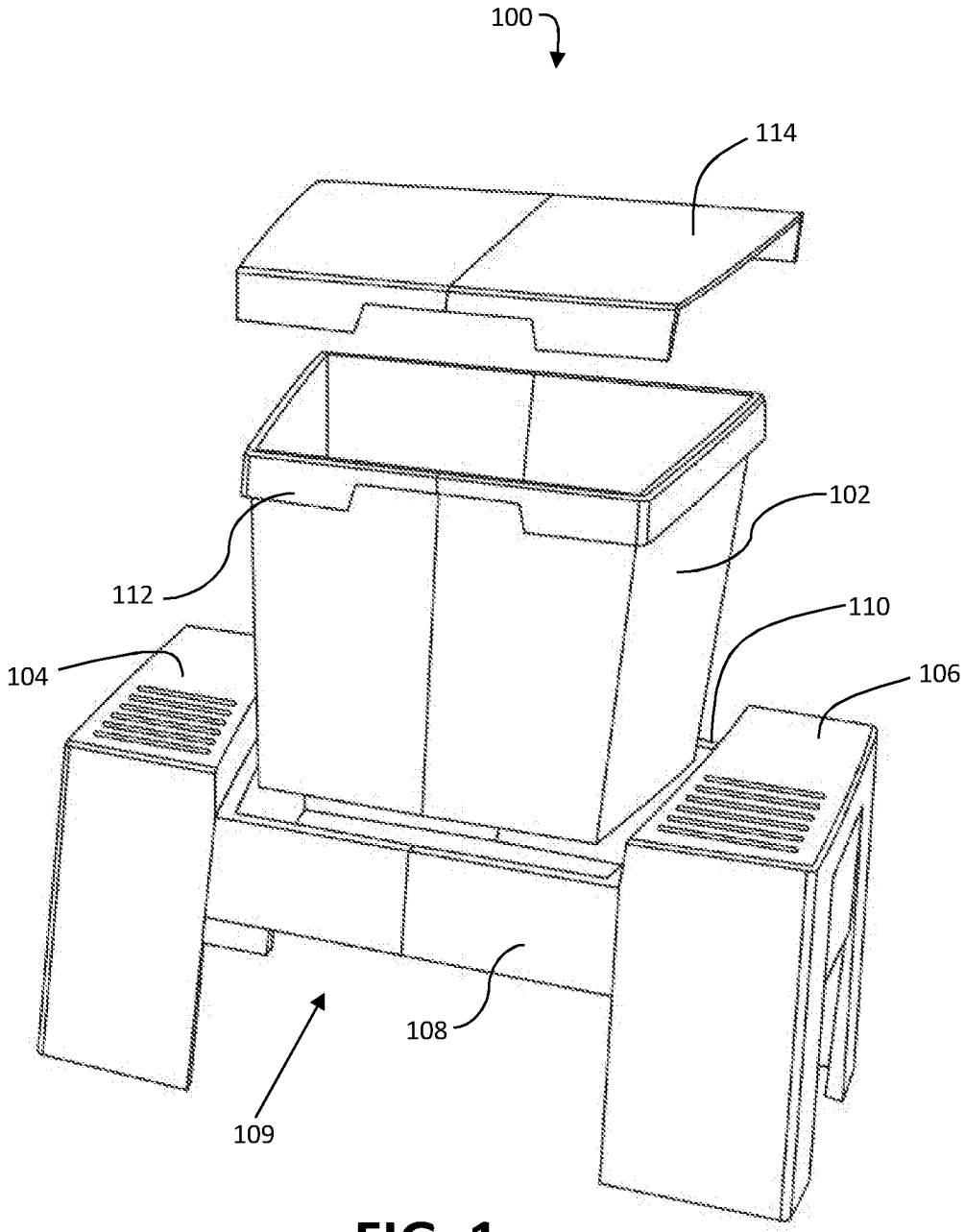
FIG. 1 is a disassembled view of a multi-purpose toilet footrest.

The following descriptions depict only example embodiments and are not to be considered limiting of its scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof.

Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

The term "coupled" may mean that two or more elements are in direct physical or electrical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

As used herein, the term "receptacle" is synonymous with container, holder, repository, and canister.

As disclosed herein, a multi-purpose toilet footrest solves several problems. For example, a toilet footrest allows a user to eliminate more easily; a waste basket allows users to dispose of other unwanted items; together, they function to save space while providing a user with the aforementioned benefits. Other combinations may include the use of the receptacle for storage of personal hygiene items, additional toilet paper, or other items.

Figure 2:
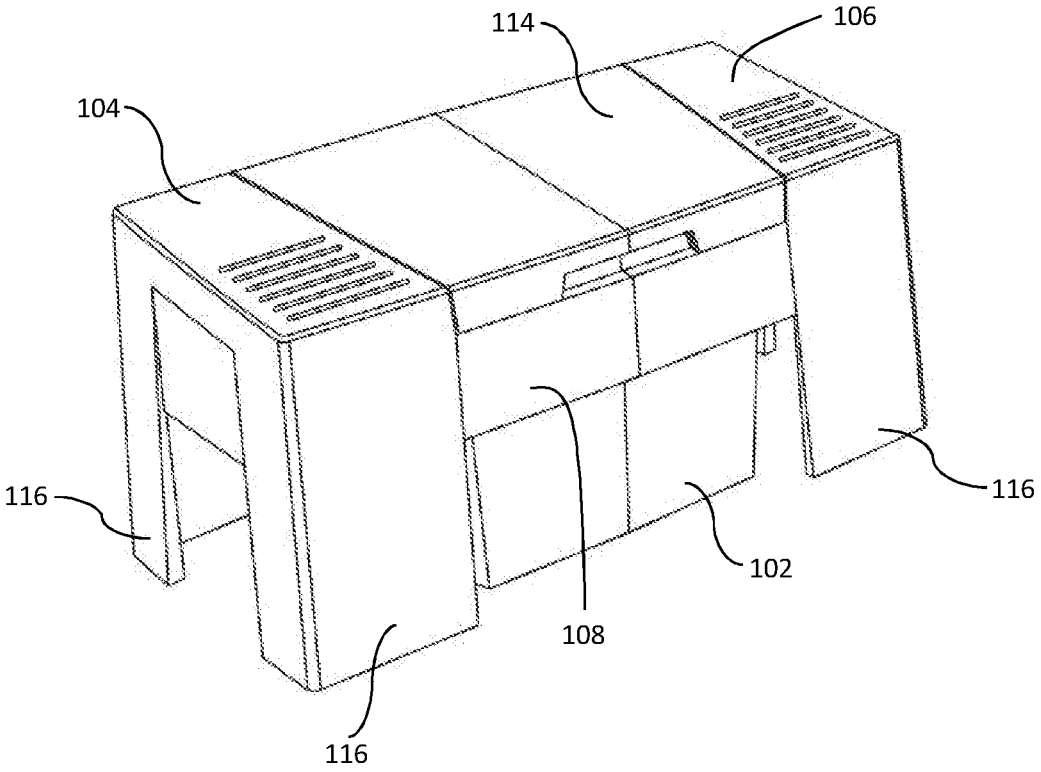
FIG. 2 is a perspective view of a multi-purpose toilet footrest.

Referring now to what is generally illustrated in FIGS. 1-2, in one embodiment, a multi-purpose footrest 100 comprises a receptacle 102, a first foot platform 104 on a first side, and second foot platform 106 on a second side. The foot platforms 104, 106 are coupled to one another via at least one bracing member 108, 110. As understood from the drawings, the configuration of the foot platforms 104, 106 and bracing members 108, 110 form an aperture/cavity 109 wherein the receptacle 102 is received. In other words, the receptacle 102 is interposed between the first foot platform 104 and second foot platform 106. It will be appreciated that the shape of the receptacle is complementary to the cavity 109, so that they nest together. Further, receptacle edge 112 is configured to seat on the one or more bracing members 108, 110. As such, if a user lifts or otherwise transports the multi-purpose toilet footrest, the receptacle 102 conveniently travels therewith. In other words, when the multi-purpose toilet footrest 100 is elevated, the receptacle 102 does not fall through the aperture/cavity 109. Further, as shown in FIG. 2, the receptacle 102 may be sized so as to seat flush with foot platforms 104, 106. While not required, lid 114 is useful to keep the contents of receptacle 102 from being visible. In such a scenario, the receptacle 102 may be sized so that the lid 114 seats so as to create a flush surface between the foot platforms 104, 106. Each foot platform 104, 106 is supported by one or more support legs 116. It will be appreciated that the support legs 116 may take any number of configurations, such as rods, telescoping poles, sidewalls (as shown), or any other support leg used in the arts of footrests and tables. The foot platforms 104, 106 are sized so as to put a user into a squatting position when using a toilet. While FIGS. 1-2 show the receptacle 102 as being removable, it need not be, and may be permanently integrated with the foot platforms 104, 106. Likewise, the lid 114 may be hingedly attached, rather than removable.

As an example of use, a user may use the receptacle 102 as a waste bin, as a storage container for personal hygiene items, as a storage container for toilet cleaners/deodorizers, or for other useful purposes. As such, a user may place the multi-purpose toilet footrest 100 at the base of a toilet for placing their feet thereon so as to obtain the correct anorectal angle. The user may also have convenient access to the stored items and/or a waste bin. The multi-purpose toilet footrest may be shaped so as to complement the base of a toilet, such as by having a recess/cutout that allows the multi-purpose toilet footrest to abut the base of the toilet better.

Figure 3:
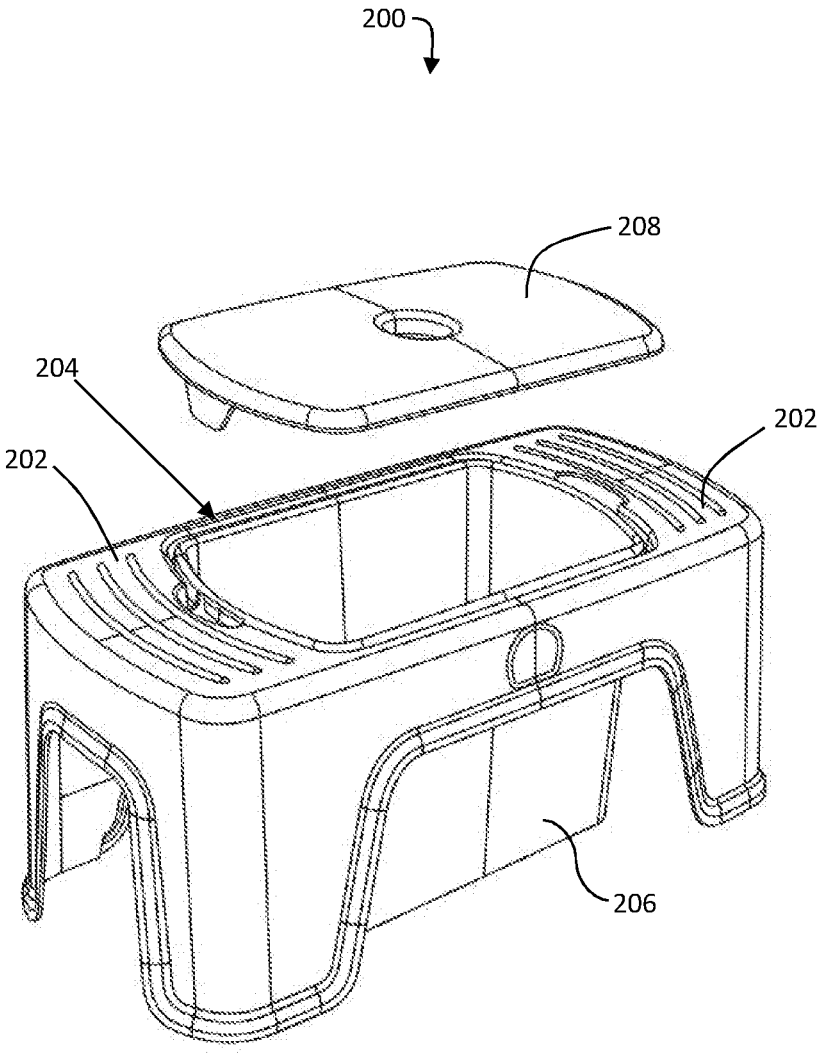
FIG. 3 is a perspective view of a multi-purpose toilet footrest with lid removed.

FIG. 3 shows an alternate configuration for a multi-purpose toilet footrest 200. Unlike FIG. 1 where two separate foot platforms 104, 106 were coupled together, FIG. 2 illustrates a multi-purpose toilet footrest having a single foot platform 202. The foot platform 202 has an aperture 204 therein for receiving a receptacle 206. A lid 208 may also be used, which seats on the receptacle 206 so as to be flush with the foot platform 202.

Figure 4:
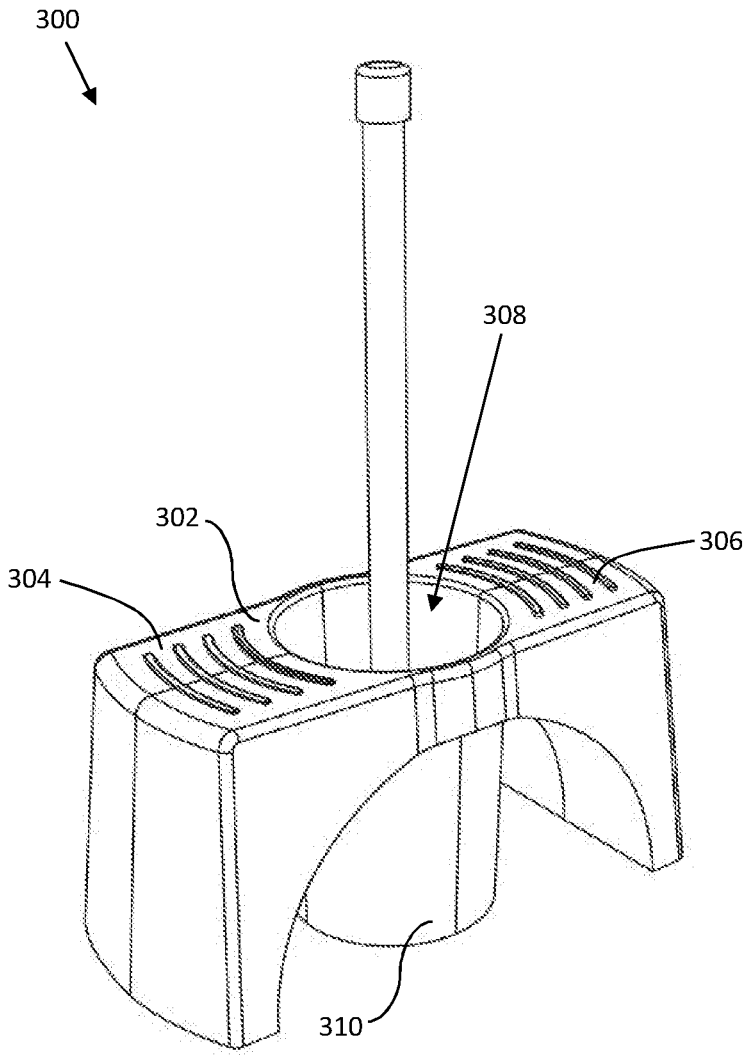
FIG. 4 is a perspective view of a multi-purpose toilet footrest.

In one embodiment, as shown in FIG. 4, a multi-purpose toilet footrest 300 comprises a foot platform 302 having a first side 304, a second side 306, and a cavity 308 therebetween. The cavity 308 is formed by descending sidewalls 310 and a base. While the cavity 308 is shown as cylindrical, it will be appreciated that any shape may be used, such as square, rectangular, triangular, etc. The multi-purpose toilet footrest 300 may be manufactured from a standard mold, so that the entire multi-purpose toilet footrest 300 is of one manufacture. The cavity 308 may be used as a receptacle itself, or may receive a receptacle. As shown in FIG. 4, the receptacle/cavity 308 may be used to store a plethora of items, including those which do not fit within the receptacle/cavity 308, but which protrude therefrom. For example, a plunger may be placed therein for storage, or a rod for holding toilet paper may be placed therein. Other uses are also be contemplated.

Further, it will be appreciated that many configurations are available for the multi-purpose toilet footrest. For example, the receptacle need not be interposed between the foot platforms, but may also be coupled to the front, back, or sides of the foot platform. In such a manner, the toilet footrest may take a variety of shapes while allowing a receptacle to be coupled thereto. This allows the user the flexibility to determine whether, and when, to couple the receptacle to the multi-purpose toilet footrest. It will be appreciated that the receptacle may be coupled to the front, back, or sides using a variety of methods, such as tongue and slot (e.g., the receptacle would have a tongue that is received into a slot on the multi-purpose toilet footrest) or other methods.

Still yet other configurations are possible. In one embodiment (not shown), a multi-purpose toilet footrest may comprise a foot platform, wherein the foot platform is hingedly attached to a base, the base being comprised of a housing and an inner space or void for receiving items directly or for receiving a receptacle sized to fit within the void. In other words, the foot platform also functions as a lid for the receptacle. It will be appreciated that, depending upon the configuration, more than one receptacle may also be present. For example, if the multi-purpose toilet footrest is shaped/configured to complement the base of a toilet (e.g., see U.S. D677478, creating a "U" shape), each foot platform may function as a lid (either separately or together), concealing a receptacle or void thereunder for the storage of items/waste. In other words, lifting the first foot platform reveals a void/receptacle and lifting the second foot platform reveals a second void/receptacle.

In one embodiment (not shown), a multi-purpose toilet footrest comprises one or more collapsible foot platforms coupled to the side of a receptacle. For example, a user may have a square waste receptacle on the side of their toilet. If desired, a user would slide the waste receptacle to the front of the toilet, would extend one or more foot platforms coupled to the side(s) of the waste receptacle, and secure them in place (e.g., supporting rods, etc.). In other words, when not in use, the foot platforms may hang vertically along the sidewalls of the multi-purpose toilet footrest. A user could then lift the one or more foot platforms up to a horizontal position, where they could be secured using a supporting rod (e.g., a diagonal rod extending from the sidewall to the distal end of the foot platform to support it). A user could then place their feet on the foot platform(s) to place their body in a squatting position.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A multi-purpose toilet footrest, comprising:

a first foot platform coupled to a second foot platform via at least one brace member; and a receptacle interposed between the first and second foot platforms, the receptacle having a removable lid that is configured to sit flush with the first and second foot platforms.

2. The multi-purpose toilet footrest of claim 1, wherein the receptacle is removable.

3. A multi-purpose toilet footrest, comprising:

a foot platform;

an aperture in the foot platform for receiving a receptacle; and a receptacle for insertion into the aperture.

4. A multi-purpose toilet footrest, comprising:

a foot platform having a receptacle therein, the receptacle formed by having one or more sidewalls extending downwardly from the foot platform and having a base.

5. A multi-purpose toilet footrest, comprising:

a receptacle removably coupleable to a foot platform, wherein the foot platform is configured to abut the base of a toilet.

* * * * *